US009863133B2

(12) United States Patent
Edwards et al.

(10) Patent No.: US 9,863,133 B2
(45) Date of Patent: Jan. 9, 2018

(54) TOILET INSTALLATION GUIDE

(76) Inventors: David E. Edwards, Peoria, AZ (US); Kellie Rae Edwards, Peoria, AZ (US)

( * ) Notice: Subject to any disclaimer, the term of this patent is extended or adjusted under 35 U.S.C. 154(b) by 1371 days.

(21) Appl. No.: 12/898,628

(22) Filed: Oct. 5, 2010

(65) Prior Publication Data

US 2012/0079649 A1 Apr. 5, 2012

(51) Int. Cl.
*E03D 11/16* (2006.01)

(52) U.S. Cl.
CPC ..... *E03D 11/16* (2013.01)

(58) Field of Classification Search
CPC ..... E03D 11/16
USPC ..... 411/373, 374, 372.5; 4/252.1–252.6
See application file for complete search history.

(56) References Cited

U.S. PATENT DOCUMENTS

| | | | | |
|---|---|---|---|---|
| 3,419,298 | A * | 12/1968 | Worley | 403/24 |
| 4,710,082 | A * | 12/1987 | Curtis | 411/373 |
| 4,850,063 | A * | 7/1989 | Abbate | 4/252.1 |
| 4,907,923 | A | 3/1990 | McGrath | |
| 5,644,830 | A * | 7/1997 | Ladouceur et al. | 29/432.2 |
| 5,782,921 | A | 7/1998 | Colleran | |
| 5,824,097 | A | 10/1998 | Gabriel et al. | |
| 6,171,342 | B1 | 1/2001 | O'Neil et al. | |
| 7,798,469 | B2 | 9/2010 | Junca | |
| 2007/0011799 | A1 | 1/2007 | Brooks | |

FOREIGN PATENT DOCUMENTS

| | | |
|---|---|---|
| EP | 0947181 | 6/2002 |
| EP | 0820739 | 6/2004 |
| JP | 07-102618 | 11/1996 |
| JP | 10-277069 | 10/1998 |
| JP | 11-309162 | 11/1999 |

OTHER PUBLICATIONS

Written Opinion of the International Searching Authority dated May 2, 2012 for PCT Application No. PCT/US2011/054439 to David Edwards et al filed Sep. 30, 2011.
The Toilet Master Jack, website images available at http://www.thetoiletmaster.com/howworks.html, last visited Feb. 22, 2012 (see Steps 4 and 5 in particular).

* cited by examiner

*Primary Examiner* — Janie Loeppke
(74) *Attorney, Agent, or Firm* — IPTechLaw

(57) ABSTRACT

Implementations of a toilet installation guide and methods for installing a toilet. Implementations of toilet installation guides may include a shaft including a bolt receiving portion configured to receive a portion of a bolt and align a length of the shaft with a length of the bolt, a taper configured to be passed through the installation hole of the toilet while lowering the toilet toward the floor, and a visual aid configured to be seen through a toilet installation hole as an installer attempts to lower the toilet onto the floor over the bolt. In implementations the shaft may selectively couple to and decouple from the bolt with threads located on an inner wall of a cylindrical opening in the shaft. In implementations the toilet installation guide may be configured to be installed and uninstalled by hand, before and after lowering the toilet to the floor, respectively, to be reused.

20 Claims, 2 Drawing Sheets

TOILET INSTALLATION GUIDE

BACKGROUND

1. Technical Field

Aspects of this document relate generally to installation aids for the placement of fixtures in edifices.

2. Background Art

Toilets are generally installed using one or more bolts fastened to the floor to ensure the toilet is held tightly to the floor. This is intended to form a seal to prevent water leakage during use. During installation, the installer generally lifts the toilet off the ground and attempts to align the toilet's installation holes with the bolts while lowering the toilet to the ground and subsequently bolts it to the floor.

SUMMARY

Implementations of toilet installation guides may include: a shaft having a shaft diameter and a shaft length, the shaft length being substantially perpendicular to the shaft diameter, the shaft further including: a bolt receiving portion at a first end of the shaft and configured to receive a portion of an end of a bolt and align the shaft length with a length of the bolt, the length of the bolt being substantially perpendicular to a diameter of the bolt; and a taper at a second end of the shaft configured to pass through an installation hole of a toilet and align the installation hole with the bolt.

Implementations of toilet installation guides may include one, all, or any of the following:

The shaft may further include a visual aid at the second end of the shaft configured to aid alignment of the installation hole of the toilet with the shaft.

The visual aid may include a bright color.

The bolt receiving portion may include a hollow cylindrical opening and a coupling element on an inner wall of the hollow cylindrical opening configured to selectively couple to the end of the bolt.

The bolt receiving portion may extend roughly ⅓ the length of the shaft.

The taper may extend roughly ⅔ the length of the shaft.

The toilet installation guide may be configured to be selectively coupled to and decoupled from the end of the bolt so as to be reusable.

The toilet installation guide may be configured to be selectively coupled to and decoupled from the end of the bolt using finger strength alone without a tool.

The taper may end in a point.

Implementations of a toilet installation guide may include: a shaft having a shaft diameter and a shaft length, the shaft length being substantially perpendicular to the shaft diameter, the shaft further including: a bolt aligner, at a first end of the shaft, configured to align the shaft length with a length of a bolt, the length of the bolt being substantially perpendicular to a diameter of the bolt, and the bolt aligner including: a bolt receiving portion configured to receive a portion of an end of the bolt; the bolt receiving portion including: a hollow cylindrical opening in the first end of the shaft; and a coupling element on an inner wall of the hollow cylindrical opening configured to selectively couple to the end of the bolt; and a taper at a second end of the shaft configured to pass through an installation hole of a toilet and align the installation hole with the bolt; and a visual aid on the second end of the shaft.

Implementations of toilet installation guides may include one, all, or any of the following:

The visual aid may include a bright color.

The coupling element may comprise threads.

The visual aid may extend roughly ⅓ of the length of the shaft.

The taper may end in a point.

The bolt receiving portion may extend roughly ⅓ the length of the shaft.

The taper may extend roughly ⅔ the length of the shaft.

The visual aid may extend along a portion of the taper.

The coupling element may be configured to selectively couple to the end of the bolt before the toilet is placed on a floor over the bolt and to decouple from the end of the bolt after the toilet has been placed on the floor over the bolt.

The coupling element may be configured to be selectively coupled to and decoupled from the end of the bolt using finger strength alone without a tool.

Implementations of a method of installing a toilet may include: coupling a toilet installation guide to an end of a bolt, the toilet installation guide including: a shaft having a shaft diameter and a shaft length, the shaft length being substantially perpendicular to the shaft diameter, the shaft further including: a bolt receiving portion at a first end of the shaft and configured to receive a portion of an end of a bolt and align the shaft length with a length of the bolt, the length of the bolt being substantially perpendicular to a diameter of the bolt; a taper at a second end of the shaft; and a visual aid at the second end of the shaft; lifting the toilet above the bolt coupled to a floor; aligning an installation hole of the toilet with the bolt by moving the toilet until the visual aid is visible through the installation hole of the toilet; passing the taper through the installation hole of the toilet while lowering the toilet toward the floor; and resting the toilet on the floor.

Implementations of a method of installing a toilet may include one, all, or any of the following:

Decoupling the toilet installation guide from the end of the bolt.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures consistent with the intended toilet installation guide and/or assembly procedures for a toilet installation guide will become apparent for use with particular implementations from this disclosure. Accordingly, for example, although particular implementations are disclosed, such implementations and implementing components may comprise any shape, size, style, type, model, version, measurement, concentration, material, quantity, and/or the like for such toilet installation guides and implementing components, consistent with the intended operation.

Figure 3:
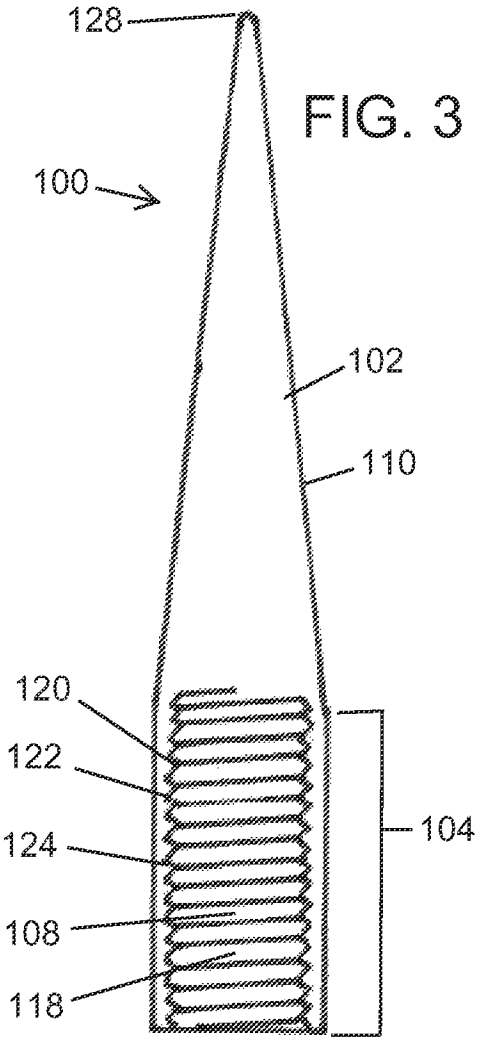
FIG. 3 is a cross section view of the toilet installation guide illustrated in FIG. 2 taken along sectional line A-A.
Figure 2:
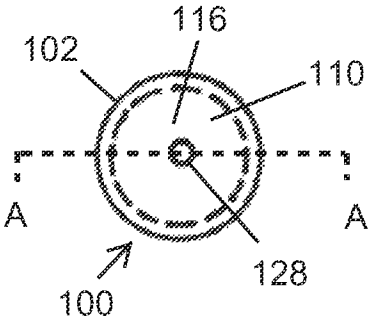
FIG. 2 is a top view of the toilet installation guide of FIG. 1.
Figure 1:
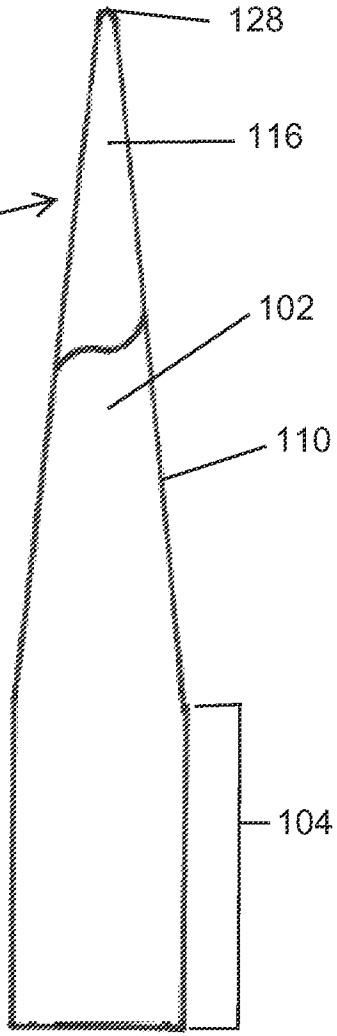
FIG. 1 is a side view of an implementation of a toilet installation guide.
Figure 4:
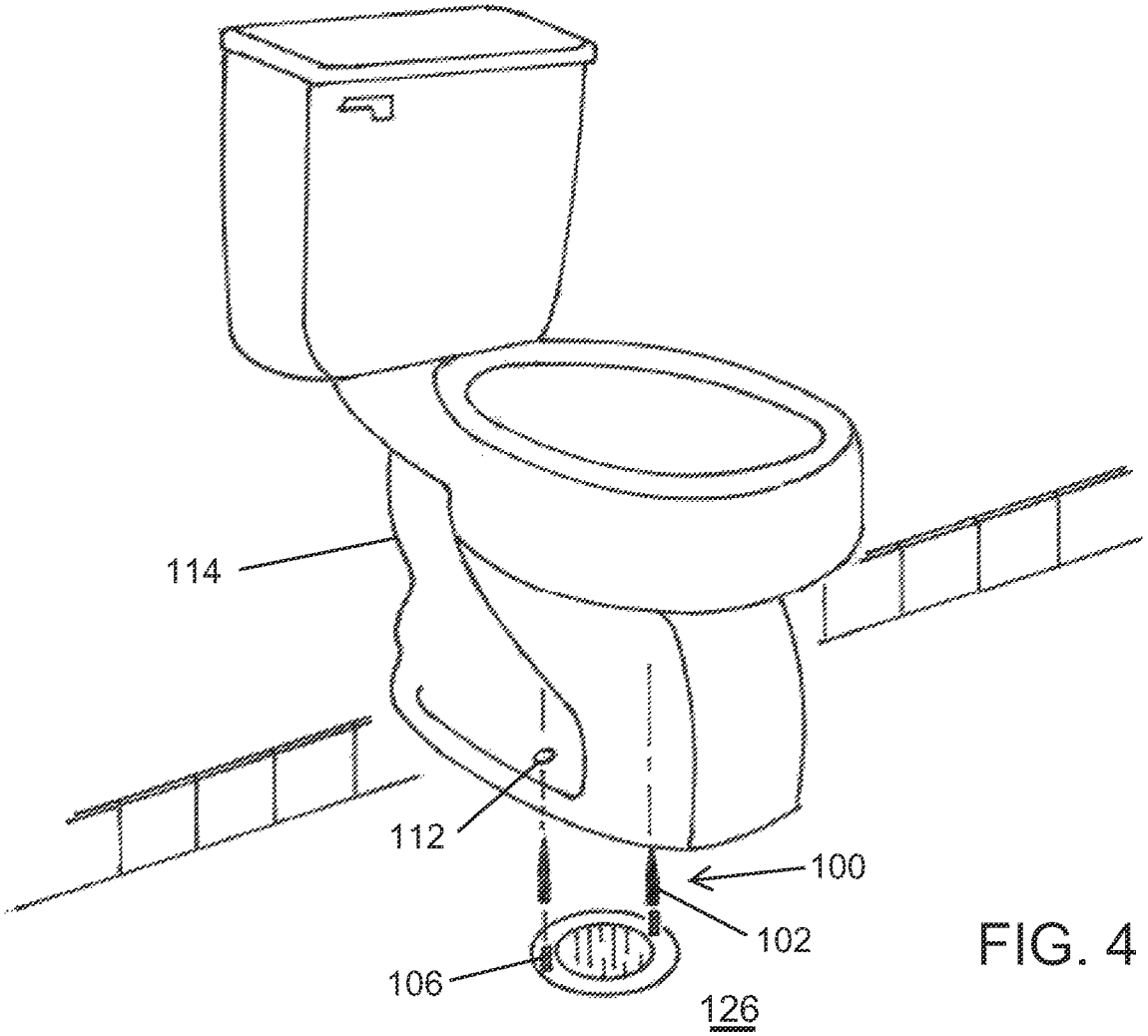
FIG. 4 is a perspective view of two implementations of toilet installation guides, a toilet, a floor, and bolts as they exist with respect to each other during installation of a toilet.

Referring now to FIG. 1, in one implementation a toilet installation guide 100 includes a shaft 102 including a shaft diameter and a shaft length, the shaft length being substantially perpendicular to the shaft diameter. The shaft diameter and shaft length may be any size in various implementations. In other implementations the shaft length may be between about 2 inches to about 3 inches in length, and the shaft diameter may be between about ¼ inch to about ½ inch in diameter. Referring now to FIGS. 1 and 4, the shaft 102 may further include a bolt aligner 104 at a first end of the shaft 102 configured to align the shaft length with a length of a bolt 106, the length of the bolt 106 being substantially perpendicular to a diameter of the bolt 106. Referring now to FIGS. 2-4, in the illustrated implementation the bolt aligner 104 includes a bolt receiving portion 108 configured to selectively receive a portion of an end of the bolt 106. In other implementations the bolt aligner 104 could be a structure other than a bolt receiving portion 108, such as a clip element that clips onto the end of the bolt 106 to achieve the alignment, or some other element which in any way attaches to or engages the end of the bolt 106 to achieve alignment.

Referring to FIGS. 3-4, in this implementation the shaft 102 further includes a taper 110 at a second end of the shaft 102. The taper 110 is configured to pass through or engage with an installation hole 112 of a toilet 114 with the shaft 102. The taper 110 achieves this because the end of the taper 110 has a small diameter, which, in particular implementations, may make it easier for a person installing the toilet 114 to align the installation hole 112 with the shaft 102.

Referring now to FIGS. 1-2 and 4, in this implementation the toilet installation guide 100 further includes a visual aid 116 at the second end of the shaft 102 configured to make the end of the shaft 102 more visible through the installation hole 112. However, other implementations of the toilet installation guide 100 may entirely omit a visual aid 116 but include a taper 110. Additionally, in other implementations the toilet installation guide 100 may include a visual aid 116 and entirely omit the taper 110. In this implementation, the visual aid 116 includes a bright color. In other implementations the visual aid 116 could include something other than a bright color, such as a reflective element or an easily seen or recognized shape, such as an "x" or a triangle or a star. The bright color in this implementation can be any color such as, by non-limiting example, red, orange, white, yellow, green, blue, or any fluorescent color or fluorescent version of one of the already mentioned colors, or any other color. In other implementations the visual aid 116 could include any combination of the above mentioned elements such as a bright color and/or a shape and/or a reflective element, and so forth.

Referring now to FIG. 1, in this implementation the visual aid 116 extends roughly ⅓ the length of the shaft 102. In other implementations the visual aid 116 could extend along other fractions of the length of the shaft 102 such as, by non-limiting example, ½, ¼, ⅕, ⅙, ⅔, ⅘, substantially the entire length of the shaft 102, or any other fraction of the length of the shaft 102. The visual aid 116 in this implementation extends along a portion of the taper 110, but in other implementations the visual aid 116 need not necessarily coincide with or extend along any portion of the taper 110.

Referring now to FIGS. 3-4, in this implementation the bolt receiving portion 108 includes a hollow cylindrical opening 118 and a coupling element 120 on an inner wall 122 of the hollow cylindrical opening 118 configured to selectively couple to the end of the bolt 106. In other implementations the bolt receiving portion 108 could be another shape such as, by non-limiting example, rectangular or triangular, or any other closed shape. In this implementation the bolt receiving portion 108 extends roughly ⅓ the length of the shaft 102, but in other implementations the bolt receiving portion 108 could extend any fraction of the length of the shaft 102, including roughly ½, ¾, substantially the entire length of the shaft, or any other fraction of the length of the shaft 102. The taper 110 in this implementation extends approximately ⅔ the length of the shaft 102, but in other implementations the taper 110 could extend any fraction of the length of the shaft 102, including, by non-limiting example, ⅓, ½, ¾, the entire length of the shaft 102, or any other fraction of the length of the shaft 102.

Referring still to FIGS. 3-4, in particular implementations, the toilet installation guide 100 may be able to be selectively coupled to and decoupled from the end of the bolt 106 so as to be reusable. In particular implementations, such as is illustrated in FIGS. 3-4, this may be achieved by including threads 124 in the coupling element 120 that are utilized to screw the toilet installation guide 100 onto the end of the bolt 106. The toilet installation guide 100 can later be unscrewed after installation of the toilet 114 over the toilet installation guide 100 and bolt 106 and subsequently reused. In this way the coupling element 120 is configured to selectively couple to the end of the bolt 106 before the toilet 114 is placed on the floor 126 to which the bolt 106 is coupled. In various implementations the threads 124 include ¼" threads or 5⁄16" threads. In other implementations the threads 124 may be of any other size, pitch, diameter, or other configuration.

Referring still to FIGS. 3-4, although this implementation utilizes threads 124, other implementations need not utilize threads 124. In other implementations the toilet installation guide 100 may instead include, by non-limiting example, a bolt aligner 104 which utilizes a clip mechanism which clips to the end of the bolt 106, a non-threaded bolt receiving portion 108 which slides over the end of the bolt 106, a magnetic bolt aligner 104 which magnetically couples to the end of the bolt 106, or any of a wide variety of other coupling systems, methods, and techniques. In the illustrated implementation, the toilet installation guide 100 is configured to be selectively coupled to and decoupled from the end of the bolt 106 using finger strength alone without a tool. In this way the toilet installation guide 100 may be installed by hand, the toilet 114 may be aligned over the toilet installation guide 100 and placed on a floor 126, and the toilet installation guide 100 may then be removed by hand for later use. In other implementations the toilet installation guide 100 need not be reusable and may be configured to be permanently engaged with, coupled to, or attached to the end of the bolt 106.

Referring to FIG. 3, in this implementation the taper 110 ends in a rounded point 128, but in other implementations the taper 110 could end in any other shape, such as, by non-limiting example, rounded, flat, convex, concave, a sharp point, or any other shape. In this implementation, the taper 110 extends roughly from an end of the bolt receiving portion 108 to the furthest extremity of the second end of the shaft 102, but in other implementations the taper 110 could extend various other fractions of the length of the shaft 102, as described above. In this implementation the coupling element 120 extends the full length of the bolt receiving portion 108, but in other implementations the coupling element 120 could extend various fractions of the bolt receiving portion 108 such as, by non-limiting example, ½, ⅓, ¼, ⅔, or any other amount of the length of the bolt receiving portion 108.

In some implementations the coupling element 120 extends along only a portion of the inner wall 122 of the hollow cylindrical opening 118. For instance, in some implementations the hollow cylindrical opening 118 includes a first end (in the direction of the first end of the shaft 102) and a second end opposite the first end, and the coupling element 120 extends along only a portion of the inner wall 122 along the second end of the opening 118. In this implementation the shaft 102 may be configured such that the first end of the shaft 102 touches the floor 126 while the coupling element 120 holds the bolt 106 after the toilet installation guide 100 has been coupled over the bolt 106. In this way, the toilet installation guide 100 may hold the bolt 106 in place while the toilet 114 is being installed.

Referring to FIGS. 1 and 3-4, in one implementation of a method of installing a toilet 114, the method may include coupling a toilet installation guide 100 to an end of a bolt 106, the toilet installation guide 100 including a shaft 102 comprising a shaft diameter and a shaft length, the shaft length being substantially perpendicular to the shaft diameter, the shaft 102 further including a bolt receiving portion 108 at a first end of the shaft 102 and configured to receive a portion of an end of a bolt 106 and align the shaft length with a length of the bolt 106, the length of the bolt 106 being substantially perpendicular to a diameter of the bolt 106, a taper 110 at a second end of the shaft 102, and a visual aid 116 at the second end of the shaft 102; lifting the toilet 114 above the bolt 106 coupled to a floor 126; aligning an installation hole 112 of the toilet 114 with the bolt 106 by moving the toilet 114 until the visual aid 116 is visible through the installation hole 112 of the toilet 114; passing the taper 110 through the installation hole 112 of the toilet 114 while lowering the toilet 114 toward the floor 126; and resting the toilet 114 on the floor 126.

In this and other implementations the method may further include decoupling the toilet installation guide 100 from the end of the bolt 106.

The method may further include resting the first end of the shaft 102 on the floor 126 while the coupling element 120 couples to the bolt 106, such that the installation guide 100 holds the bolt 106 in place while the toilet 114 is being installed.

Implementations of the method may utilize any of the implementations of toilet installation guides disclosed herein.

Those of ordinary skill in the art will understand how to fabricate the toilet installation guide either as a single unit or as several pieces to later be joined by a manufacturer, distributor, or end user. The shaft 102 may be made of any material or combination of materials, such as, by non-limiting example, plastic, PVC, metal, nylon, paper, cardboard, wood, composite, wood composite, ceramic, and any other material. The shaft 102 may also be formed using a wide variety of manufacturing methods, including extrusion, pultrusion, machining, lathing, casting, molding, blow molding, cutting, paper and cardboard forming techniques, and any other manufacturing technique.

In places where the description above refers to particular implementations of a toilet installation guide or of a method for installing a toilet using a toilet installation guide, it should be readily apparent that a number of modifications may be made without departing from the spirit thereof and that these implementations and methods may be applied to other toilet installation guides and other methods for installing a toilet using a toilet installation guide.

The invention claimed is:

1. A toilet installation guide, comprising:

a shaft comprising a shaft diameter and a shaft length, the shaft length being substantially perpendicular to the shaft diameter, the shaft comprising a substantially conical section terminating in a substantially cylindrical section, the shaft further comprising:

a bolt receiving portion at a first end of the shaft and configured to receive a portion of an end of a bolt and align the shaft length with a length of the bolt, the length of the bolt being substantially perpendicular to a diameter of the bolt; and a taper at a second end of the shaft configured to pass through an installation hole of a toilet and align the installation hole with the bolt;

wherein the shaft comprises no male threads.

2. The toilet installation guide of claim 1, wherein the shaft further comprises a visual aid at the second end of the shaft configured to aid alignment of the installation hole of the toilet with the shaft, the visual aid comprising a bright color.

3. The toilet installation guide of claim 1, wherein the bolt receiving portion comprises a hollow cylindrical opening and a coupling element on an inner wall of the hollow cylindrical opening configured to selectively couple to the end of the bolt.

4. The toilet installation guide of claim 1, wherein the bolt receiving portion extends roughly ⅓ the length of the shaft.

5. The toilet installation guide of claim 1, wherein the taper extends roughly ⅔ the length of the shaft.

6. The toilet installation guide of claim 1, wherein the toilet installation guide is configured to be selectively coupled to and decoupled from the end of the bolt so as to be reusable.

7. The toilet installation guide of claim 1, wherein the toilet installation guide is configured to be selectively coupled to and decoupled from the end of the bolt using finger strength alone without a tool.

8. The toilet installation guide of claim 1, wherein the taper ends in a point.

9. A toilet installation guide, comprising:

a shaft comprising a shaft diameter and a shaft length, the shaft length being substantially perpendicular to the shaft diameter, the shaft comprising a substantially conical section terminating in a substantially cylindrical section, the shaft further comprising:

a bolt aligner at a first end of the shaft and configured to align the shaft length with a length of a bolt, the length of the bolt being substantially perpendicular to a diameter of the bolt, and the bolt aligner comprising:

a bolt receiving portion configured to receive a portion of an end of the bolt, the bolt receiving portion comprising:

a hollow cylindrical opening in the first end of the shaft; and a coupling element on an inner wall of the hollow cylindrical opening configured to selectively couple to the end of the bolt; and a taper at a second end of the shaft configured to pass through an installation hole of a toilet and align the installation hole with the bolt; and a visual aid on the second end of the shaft;

wherein all of an outer surface of the shaft which is configured to extend above the installation hole when the toilet is placed on a floor is smooth.

10. The toilet installation guide of claim 9, wherein the visual aid comprises a bright color.

11. The toilet installation guide of claim 9, wherein the coupling element comprises threads.

12. The toilet installation guide of claim 9, wherein the visual aid extends roughly ⅓ of the length of the shaft.

13. The toilet installation guide of claim 9, wherein the taper ends in a point.

14. The toilet installation guide of claim 9, wherein the bolt receiving portion extends roughly ⅓ the length of the shaft.

15. The toilet installation guide of claim 9, wherein the taper extends roughly ⅔ the length of the shaft.

16. The toilet installation guide of claim 9, wherein the visual aid extends along a portion of the taper.

17. The toilet installation guide of claim 9, wherein the coupling element is configured to selectively couple to the end of the bolt before the toilet is placed on a floor over the bolt and to decouple from the end of the bolt after the toilet has been placed on the floor over the bolt.

18. The toilet installation guide of claim 9, wherein the coupling element is configured to be selectively coupled to and decoupled from the end of the bolt using finger strength alone without a tool.

19. A method of installing a toilet comprising:

coupling a toilet installation guide to an end of a bolt, the toilet installation guide comprising:

a shaft comprising a shaft diameter and a shaft length, the shaft length being substantially perpendicular to the shaft diameter, the shaft comprising a substantially conical section terminating in a substantially cylindrical section, the shaft further comprising:

a bolt receiving portion at a first end of the shaft and configured to receive a portion of an end of a bolt and align the shaft length with a length of the bolt, the length of the bolt being substantially perpendicular to a diameter of the bolt;

a taper at a second end of the shaft; and a visual aid at the second end of the shaft;

lifting the toilet above the bolt coupled to a floor;

aligning an installation hole of the toilet with the bolt by moving the toilet until the visual aid is visible through the installation hole of the toilet;

passing the taper through the installation hole of the toilet while lowering the toilet toward the floor;

resting the toilet on the floor, and extending a portion of the shaft above the installation hole, wherein the entire portion of the shaft extending above the installation hole, when the toilet is resting on the floor, comprises a smooth outer surface.

20. The method of claim 19, further comprising decoupling the toilet installation guide from the end of the bolt.

* * * * *